United States Patent [19]

Meadows

[11] Patent Number: 4,496,203

[45] Date of Patent: Jan. 29, 1985

[54] DRILL PIPE SECTIONS

[75] Inventor: Alan Meadows, Burton-on-Trent, England

[73] Assignee: Coal Industry (Patents) Limited, London, England

[21] Appl. No.: 380,385

[22] Filed: May 20, 1982

[30] Foreign Application Priority Data

May 22, 1981 [GB] United Kingdom ..... 8115799

[51] Int. Cl.[3] ..... H01R 15/30

[52] U.S. Cl. ..... 339/16 C; 339/16 RC

[58] Field of Search ..... 339/15, 16; 340/853, 340/856, 857, 858

[56] References Cited

U.S. PATENT DOCUMENTS

| | | | |
|---|---|---|---|
| 3,696,332 | 10/1972 | Dickson, Jr. et al. | 340/853 |
| 3,879,097 | 4/1975 | Oertle | 340/856 |
| 4,095,865 | 6/1978 | Denison et al. | 340/857 |
| 4,220,381 | 9/1980 | Van der Graaf | 339/16 C |

FOREIGN PATENT DOCUMENTS

| | | | |
|---|---|---|---|
| 1465950 | 5/1969 | Fed. Rep. of Germany | 339/16 R |

*Primary Examiner*—John McQuade

*Attorney, Agent, or Firm*—James C. Wray

[57] ABSTRACT

A drill pipe section enables electrical information signals to be transmitted along a borehole to feed information generated by instruments situated adjacent to the drilling bit along the drill string to monitoring and/indication equipment situated adjacent to the drilling machine. The section comprises a generally cylindrical housing member and a liner member fixedly mounted inside the housing member with an air gap defined between the two members. An electrically conductive element extends between two electrically conductive, annular coupling components one of which defines a radially inwardly directed coupling margin and the other of which defines a radially outwardly directed coupling margin.

12 Claims, 10 Drawing Figures

DRILL PIPE SECTIONS

This invention relates to drill pipe sections which in use are connected end to end to form a drill pipe string along a borehole.

In particular, the invention relates to drill pipe sections which enable electrical signals to be transmitted along the borehole in order to feed information generated by instruments situated adjacent to the drilling bit along the drill string to monitoring and/or indication equipment situated adjacent to the drilling machine. Also, instruction signals may be fed from control equipment situated adjacent the mouth of the borehole to receiving equipment located within the borehole.

It is known to feed a continuous hard wire along the central aperture defined by hollow drill sections and although such systems tend to give efficient signal transmission they suffer from the disadvantage that the hard wire has to be threaded through new sections added to the string as the borehole is extended. Also the hard wire has to be unthreaded from each section when the drill string is removed from the borehole.

Other known systems comprise generating pulses in the drilling mud flowing along the central aperture. Unfortunately, such systems tend to have slow response times and are unsuitable for transmitting information signals from a plurality of instruments at high rates of data transmission.

Still other known systems utilise electromagnetic propagated signals. Unfortunately, the range and frequency of signal transmission with these systems tends to be low.

Of the known systems the use of a hard wire tends to be the most efficient and reliable as far as information signal transmitting is concerned. However, the tedious, time consuming operation of threading and unthreading the hard wire has given rise to the search for an improved convenient system.

An object of the present invention is to provide a drill pipe section which enables information signals to be transmitted efficiently along the drill string and which does not require the aforementioned tedious and time consuming procedure previously associated with hard wire techniques.

According to the present invention a drill pipe section for connection to adjacent drill pipe sections which, in use, are connected end to end to form a drill pipe string extending along a borehole, comprise a generally cylindrical housing member of electrically conductive material, a generally cylindrical lining member of relatively high resistance to electrical conduction and fixedly mounted in side and co-axial with the housing member, an electrically conductive element extending in a general direction along the two generally cylindrical members and effectively sandwiched between portions of the two generally cylindrical members, the electrically conductive element being electrically isolated from the housing member, and two effectively annular electrically conductive coupling components associated with the ends of the electrically conductive element, respectively, one of the electrically conductive coupling components defining a radially inwardly directed electrically conductive coupling margin and the other of the two electrically conductive coupling components defining a radially outwardly directed electrically conductive coupling margin.

Preferably, a body of material of low dielectric constant is provided between the two members.

Advantageously, the body is defined by an air gap.

Conveniently, the generally cylindrical member of relative high resistance to electrical conduction comprises a collar adjacent to each end of the member.

Preferably, each of the electrically coupling components is formed by a high conductivity metal annulus around a portion of the generally cylindrical member of relatively high resistance to electrical conduction.

Preferably, one end of the housing member is provided with a male threaded portion and the other end of the housing member is provided with a female threaded portion.

Preferably, the generally cylindrical lining member of relatively high resistance to electrical conductivity associated with the end of the housing member provided with the male threaded portion is set back from the end of the housing member and projects from the end of the housing member provided with the female threaded portion.

By way of example, one embodiment of the present invention now will be described with reference to the accompanying drawings, in which.

Figure 1:
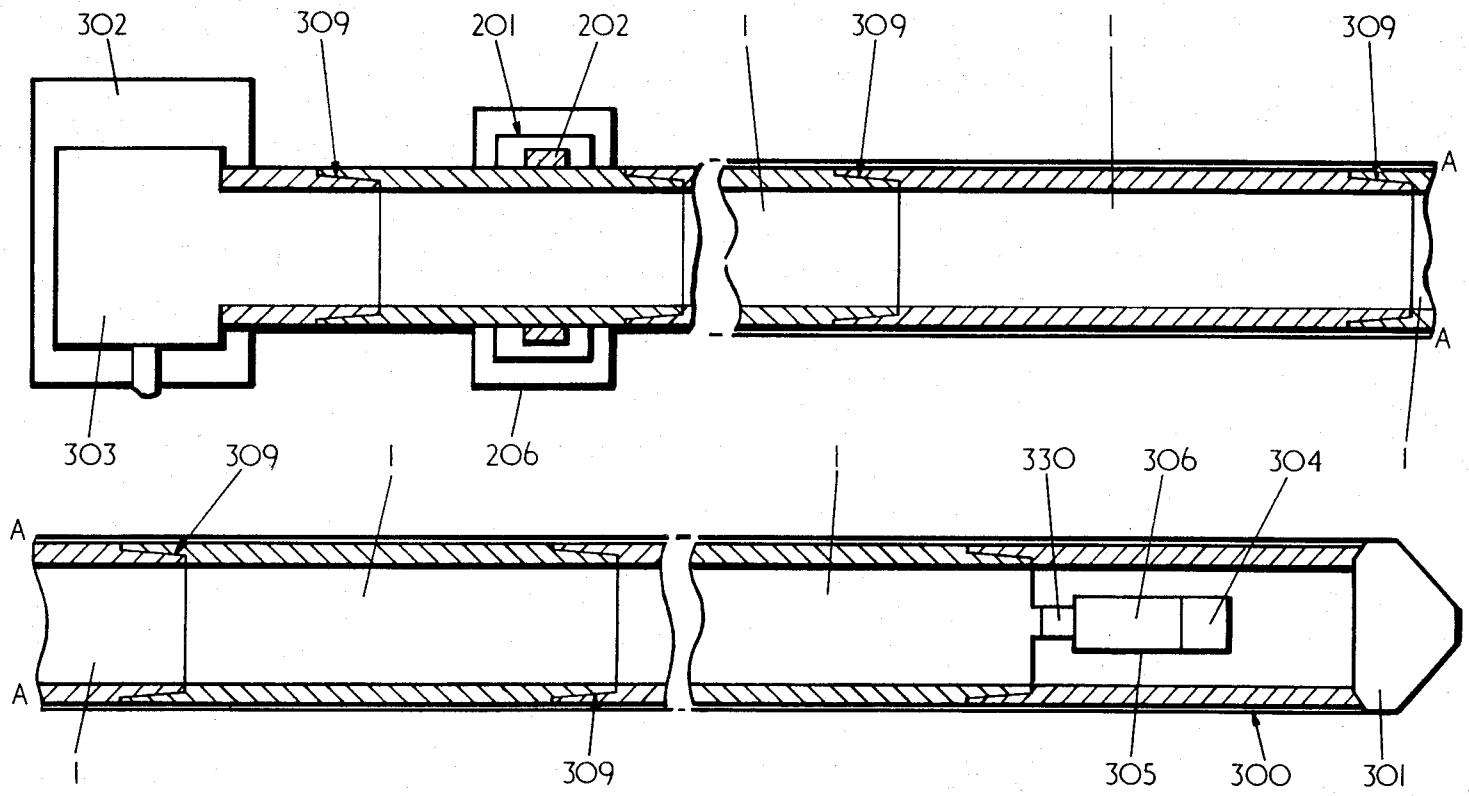
FIG. 1 is a diagrammatic view of a drill pipe string within a borehole.
Figure 2:
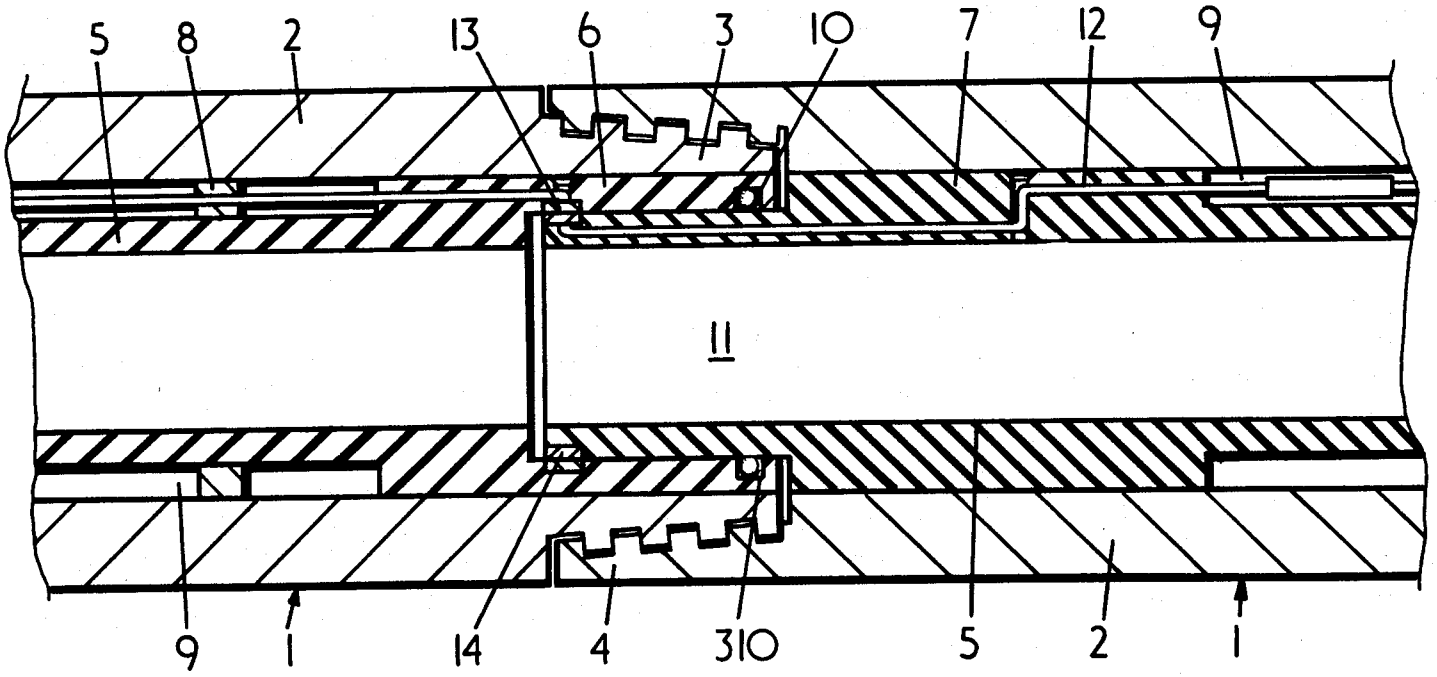
FIG. 2 is a longitudinal sectional view taken through a part of an end portion of two connected drill pipe sections constructed in accordance with the present invention.
Figure 3:
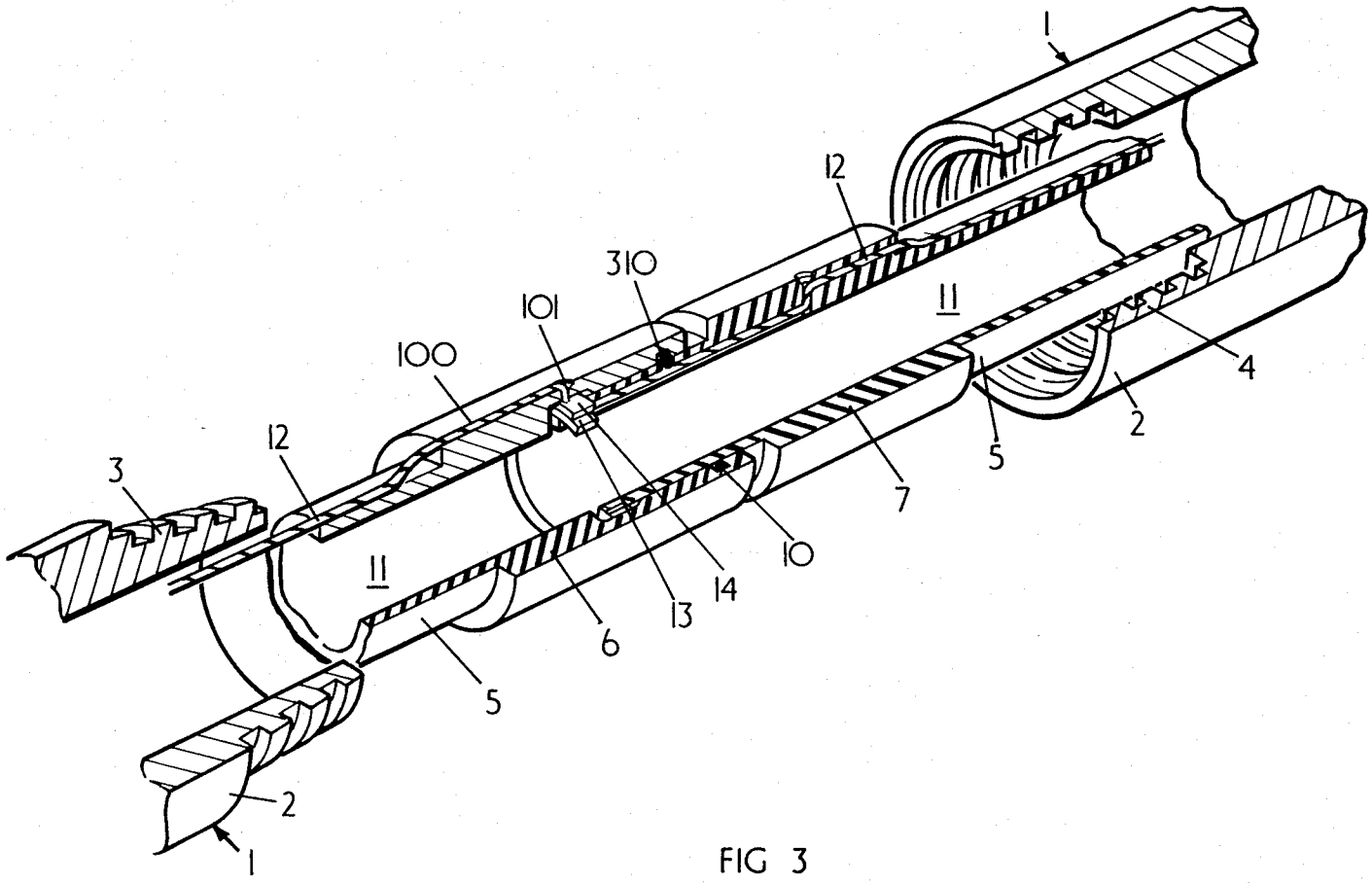
FIG. 3 is a sectioned, partly exploded perspective view through an end portion of two connected drill pipe sections as shown in FIG. 2.

FIG. 1 diagrammatically shows an assembled drill pipe string excavating a substantially horizontal borehole 300, the drilling equipment comprising a drill bit 301, a plurality of connected drill pipe sections 1 and a drilling machine 302 mounted adjacent to the mouth of the borehole and including a water feed swivel arrangement 303 for feeding water and/or drilling mud along the pipe train.

An instrument package transmitter 305 comprises sensor means 304 for surveying the position and/or orientation of the borehole within the rock or mineral strata and for deriving signals indicative of the sensed conditions, the signal being fed to an electronic circuit device 306 arranged to feed indicative signals along longitudinal electrically conductive means extending along the drill pipe string to a slip ring arrangement 201 associated with monitoring and/or control equipment 206 adapted to receive the indicative signals conveyed along the drill pipe string. Also the arrangement might be adapted to feed instructional signals from the monitoring and/or control equipment via the slip ring arrangement and along longitudinal electrically conductive means to actuable means mounted adjacent to the drill bit for controlling steering of the drill pipe string within the strata.

The drill pipe sections 1 are connected by joints 309 constructed in accordance with the present invention and shown in detail in the accompanying drawings FIGS. 2 to 9.

It will be appreciated that although the borehole 300 is shown in FIG. 1 to be substantially horizontal in other installations the borehole could be inclined or substantially vertical.

FIGS. 2 to 9 show the drill pipe sections to be of generally hollow cylindrical form and in the drawings only the end portions of the elongated sections are shown.

Each pipe section 1 comprises a generally cylindrical housing member 2 of electrically conductive material, for example, steel, the opposite ends of the member 2 being provided with a male threaded portion 3 and a female threaded portion 4, respectively. In FIGS. 2 to 7 of the accompanying drawings the male and female threaded portions of two adjacent pipe sections are shown drivably connected.

Figure 8:
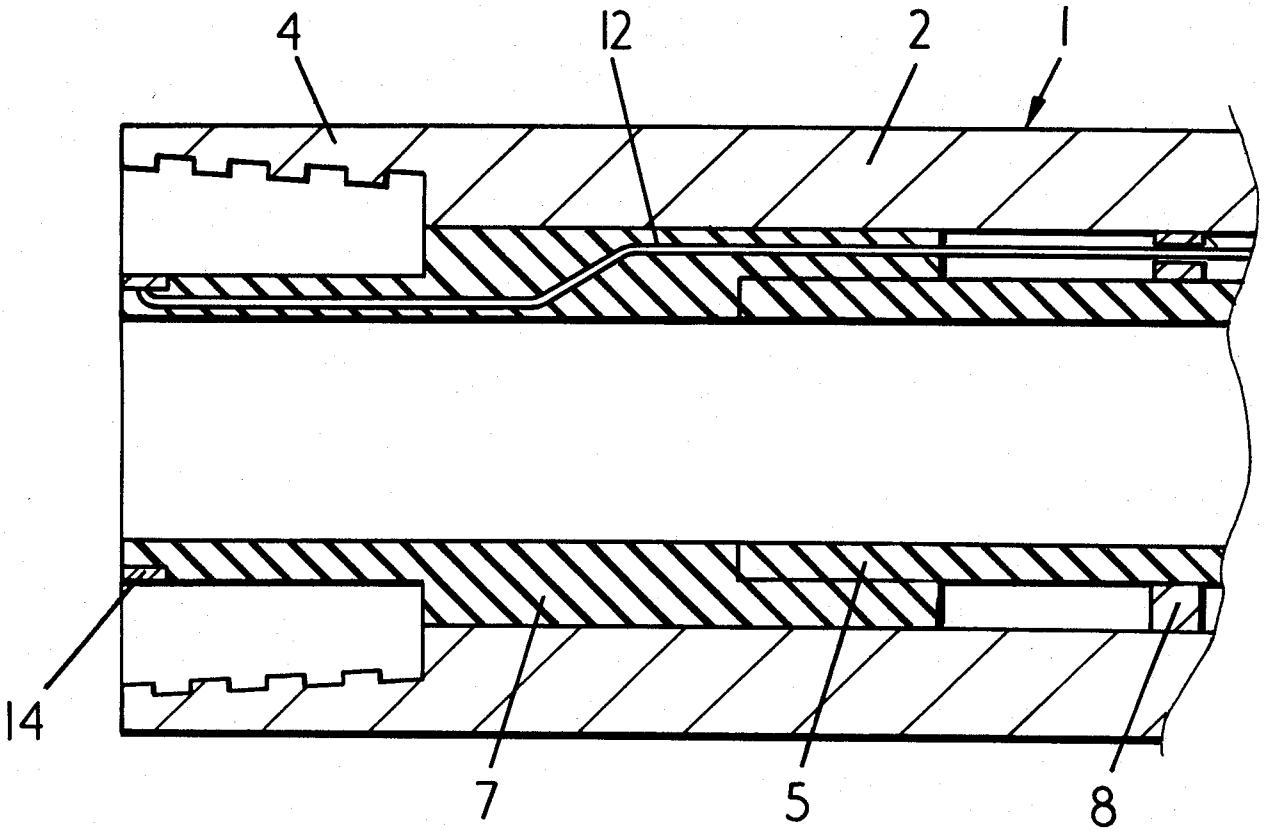
FIG. 8 is a longitudinal sectional view taken through one end of a disconnected drill pipe section constructed in accordance with the present invention.
Figure 9:
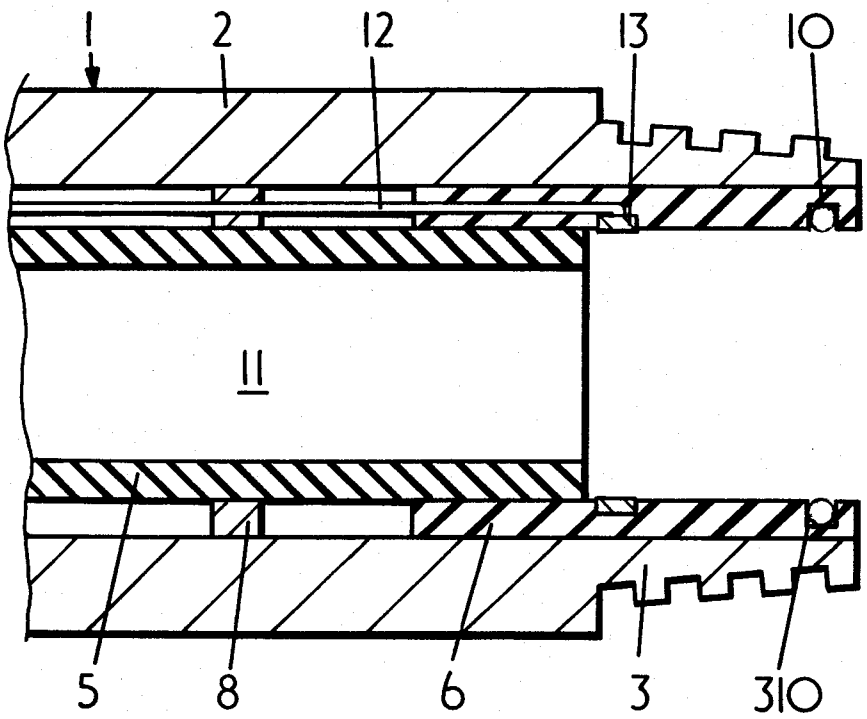
FIG. 9 is a longitudinal sectional view taken through the opposite end of the disconnected drill pipe section to that shown in FIG. 8.

FIGS. 8 and 9 show opposite ends of a disconnected pipe section.

Figure 10:
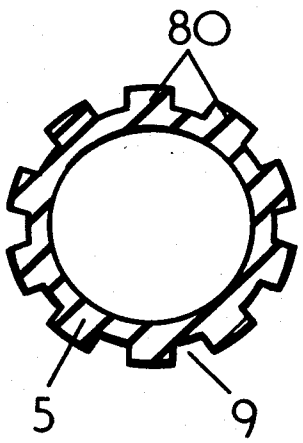
FIG. 10 is an incomplete cross-sectional view of a part of a drill pipe section which is slightly modified from that shown in the previous Figures.

Each drill pipe section 1 also comprises a generally cylindrical lining member 5 of relatively high resistance to electrical conduction, for example, plastics, the member 5 being fixedly mounted inside, and co-axial with, the housing member 2. Two collars 6 and 7 of relatively high resistance to electrical conduction, for example, plastics, are provided adjacent the ends of the member 5 and sandwiched between the members 2 and 5. In FIGS. 2 to 6 the collars 6 and 7 are shown to be integral with the associated member and in FIGS. 8 and 9 the collars 6 and 7 are shown as separate items from the member 5. Elsewhere away from the collars 6 and 7 a gap 9 is maintained between the members 2 and 5 the gap containing a body of material of low dielectric constant as for example air, foam plastic material or resin. In the case of an air gap a plurality of annular spacers 8 (only one of which is shown) are provided, the spacers being of relatively high resistance to electrical conductivities. In the slightly modified construction shown in FIG. 10 the annular rings 8 have been dispensed with and the longitudinal air gap 9 is defined by radially extending ribs 80.

A seal 10 is provided between the two collars 6 and 7 of the two connected sections which together with the relatively long aforementioned overlap between the end member 5 and the collar 6 tends to prevent significant leakage of drilling mud flowing along the centre aperture 11 defined by the sections. The seal 10 is shown to be set back from the end of the collar 6 and housed in a recess 310 formed in the collar.

Each drill pipe section also comprises an electrically conductive element 12, for example, a plastic coated wire or coaxial cable extending in a general direction along the two generally cylindrical members 2 and 5 and effectively sandwiched between portions of the two members 2 and 5, the element 12 being electrically isolated from the housing member 2. Two effectively annular electrically conductive coupling components 13 and 14 are provided at the opposite ends of the element 12, respectively. The component 13 defines a radially inwardly directed electrically conductive coupling margin and the component 14 defining a cooperating radially outwardly directed electrically conductive coupling margin. As seen in the drawings the two coupling margins on the components 13 and 14 of connected adjacent sections overlap. Advantageously, ohmic electrical conduction between two adjacent coupling margins is achieved by the two components contacting.

In use, when a plurality of drill pipe sections 2 are connected end to end an effectively hard wire connection is provided along the full length of the drill string. Thus, information signals can be transmitted efficiently from instruments mounted adjacent to the drilling bit to monitoring and/or indicating equipment mounted adjacent to the drilling machine. The effectively hard wire connection is extended each time a new section is added without the need for any threading procedure.

Leakage of drilling mud and thereby leakage of information signals at the joints and at the ends of the drill string is maintained to an acceptance level. This is achieved by fitting each drill pipe section 1 with the insulating plastics liner member 5. The collars 6 and 7, and spacers 8 (or 80) tend to ensure that the liner member 5 is held centrally inside the housing member 2.

Also the collars 6 and 7 at the ends of the drill pipe sections are fitted to provide spigot and socket joint connections.

In addition, contact between the annular coupling components 13 and 14 and the drilling mud inside the liner member has no detrimental electrical effect on the transmission of the information signals. The fact, in some instances such contact may be found to tend to assist with the transmission to the same extent as the mud acts as an additional electrical conduction. Also, the presence of the aqueous drilling mud tends to lower the contact resistance between the coupling margins of adjacent pipe sections.

Any leakage of drilling mud to the outside of the drill pipe sections must take place along a tenuous path formed by the very narrow annular gap between the liner members adjacent to the male threaded end portion 3 of the housing member and the lower member adjacent to the female threaded end portion 4. Also leakage must occur by the 'O' ring seal 10. Typically, the electrical impedence of this gap can be several orders of magnitude greater than the impedence of the joint between the two conducting members. Thus, if leakage does occur the attenuation at the joint is insignificantly small.

Although an electrical "shorting" effect is unavoidable at the two extremities of the drill string, ie at the drilling bit and at the swivel joint connection with the drilling machine, this effect can be tolerated because of the high impedence of the system.

Conveniently, the element 12 is potted in a groove 100 extending along the associated member 5, or collar 6 or 7 substantially radial passages 101 being provided to enable the elements to pass from the associated ring 14 to the groove 100.

Figure 4:
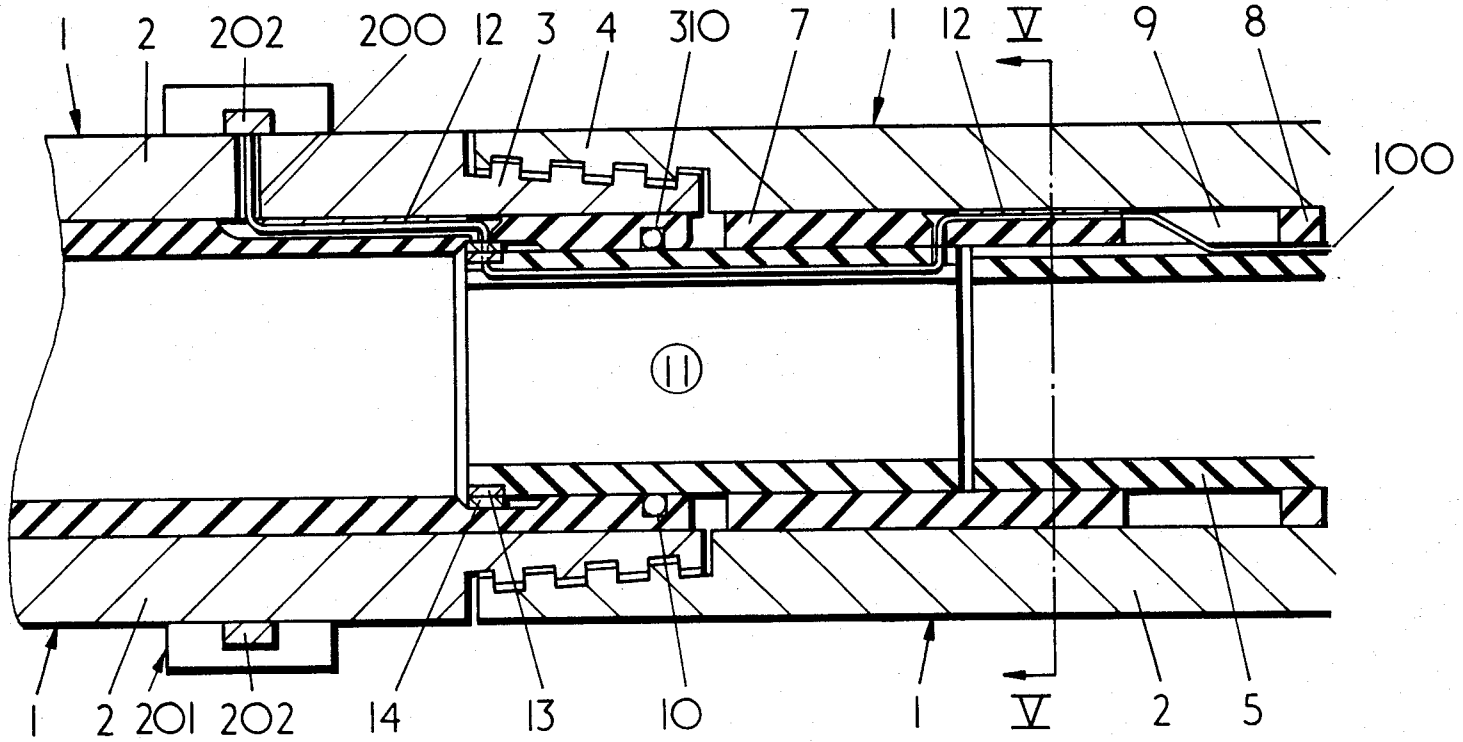
FIG. 4 is a longitudinal sectional view taken through an end portion of two connected drill pipe sections, one of the sections being adapted to convey signals between monitoring and/or control equipment situated adjacent to the mouth of the borehole and longitudinal electrically conduction means extending along the borehole.
Figure 5:
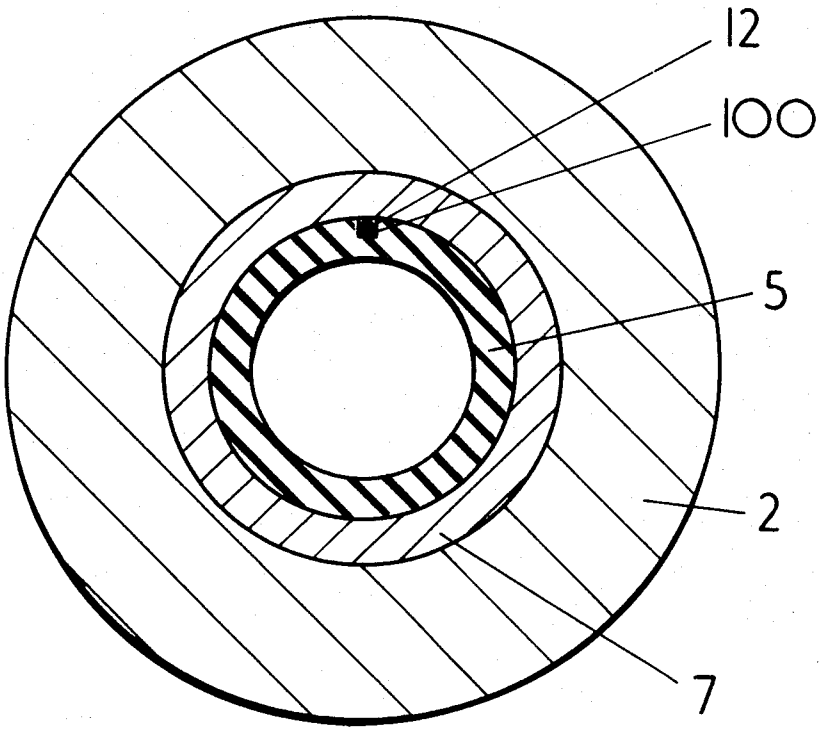
FIG. 5 is a cross-section taken along line V—V of FIG. 4.

FIGS. 4 and 5 show the pipe section which in use is adjacent to the drilling machine for rotating the drill string. The section 2 is provided with an radially extending passage 200 enabling the element 12 to pass from within the drill pipe section where it is in contact with the ring 14 to a slip ring arrangement 201 provided with a slip ring 202. The slip ring arrangement permits signals from the sensor means mounted adjacent to the drill bit to be conveyed via the electrically conductive elements 12 extending along the drill pipe string to be transmitted to monitoring and/or control equipment situated adjacent to the mouth of the borehole and externally of the borehole. Also instruction signals can be transmitted from the monitor/control equipment via the slip ring arrangement to the elements 12 and thereby to actuable means located in the borehole. Such actuable means might for example adjust the steering of the drill bit within the rock or mineral strata.

Figure 7:
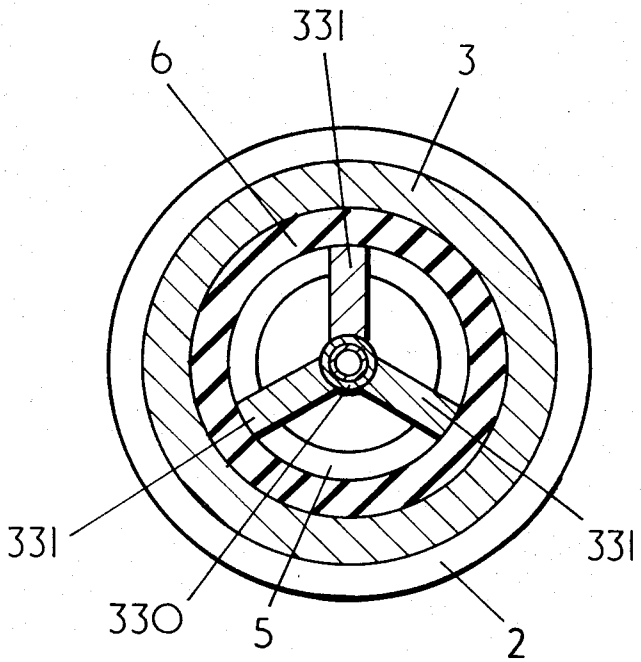
FIG. 7 is a cross-sectional view substantially taken along line VII—VII of FIG. 6.
Figure 6:
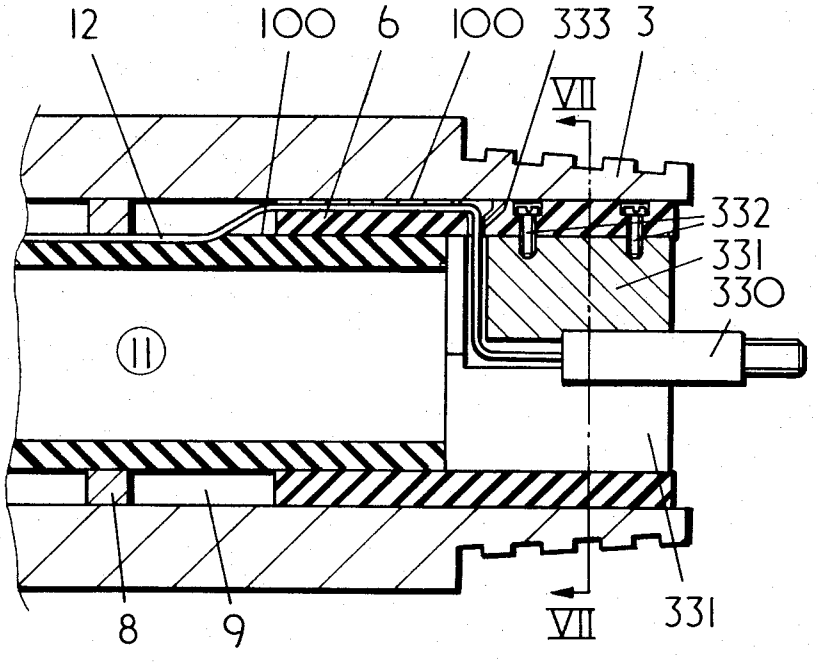
FIG. 6 is a longitudinal sectional view taken through an end portion of two connected drill pipe sections, one of the sections being adapted to convey signals between sensor and/or activated means located within the borehole adjacent to the drill bit and the longitudinal electrically conductive means extending along the borehole.

FIGS. 6 and 7 show the pipe section which in use is adjacent to a terminal 330 of the instrument package transmitter terminal for connection to sensor means. The transmitter terminal 330 is carried along the axis of the drill pipe section by three spaced arms 331 secured to the pipe section by screws 332. A radial passage 333 permits the element 12 to pass from the longitudinal groove 100 in the collar 6 to the inner portion of the pipe section.

The spacer arms 331 permit drilling mud to flow virtually unhindered along the drill pipe section.

I claim:

1. A drill pipe section for connection to adjacent drill pipe sections which, in use, are connected end to end to form a drill pipe string extending along a borehole, comprising a generally cylindrical housing member of electrically conductive material, a generally cylindrical lining member of relatively high resistance to electrical conduction and fixedly mounted inside and co-axial with the housing member, an electrically conductive element extending in a general direction along the two generally cylindrical members and effectively sandwiched between portions of the two generally cylindrical members, the electrically conductive element being electrically isolated from the housing member, and two annular electrically conductive coupling components associated with the ends of the electrically conductive element, respectively, one of the electrically conductive coupling components defining a radially inwardly directed electrically conductive coupling margin and the other of the two electrically conductive coupling components defining a radially outwardly directed electrically conductive coupling margin, the electrically conductive coupling components being formed by recessing the annular component into the lining member.

2. A section as claimed in claim 1, in which a body of material of low dielectric constant is provided between the two members.

3. A section as claimed in claim 2, in which the body is defined by an air gap.

4. A section as claimed in claim 2, in which the generally cylindrical lining member of relative high resistance to electrical conductive comprises a collar adjacent to each end of the lining member.

5. A section as claimed in claim 4, in which each of the electrically coupling components is formed by placing the annular component around a portion of the generally cylindrical lining member of relatively high resistance to electrical conduction.

6. A section as claimed in claim 5, in which one end of the housing member is provided with a male threaded portion and the other end of the housing member is provided with a female threaded portion.

7. A section as claimed in claim 6, in which one end portion of the generally cylindrical lining member of relatively high resistance to electrical conductivity associated with the end of the housing member provided with the male threaded portion is set back from the end of the housing member and the opposite end portion of the generally cylindrical lining member projects from the end of the housing member provided with the female threaded portion.

8. A drill pipe string comprising a plurality of sections, each section being connected to an adjacent section and comprising a generally cylindrical housing member of electrically conductive material, a generally cylindrical lining member of relatively high resistance to electrical conduction and fixedly mounted inside and co-axial with the housing member, an electrically conductive element extending axially between the housing member and the lining member and effectively sandwiched between portions of the housing member and the lining member, the electrically conductive element being electrically isolated from the housing member, and two annular electrically conductive coupling components associated with the ends of the electrically conductive element, respectively, being recessed in the lining member one of the electrically conductive coupling components defining a radially inwardly directed electrically conductive coupling margin and the other of the two electrically conductive coupling components defining a radially outwardly directed electrically conductive coupling margin.

9. A section as claimed in claim 1 wherein the electrically conductive material is steel.

10. A pipe string as claimed in claim 8 wherein the electrically conductive material is steel.

11. A section as claimed in claim 1 wherein the electrically coupling components are mounted on collars provided at opposite ends of the generally cylindrical lining member, the collars being such that in use when adjacent pipe sections are connected, the cooperating collars of the two connected sections have a relatively long overlap tending to prevent leakage.

12. A drill pipe section for connection to adjacent drill pipe sections which, in use, are connected end to end to form a drill pipe string extending along a borehole, comprising a generally cylindrical housing member of electrically conductive material, a generally cylindrical lining member of relatively high resistance to electrical conduction and fixedly mounted inside and co-axial with the housing member, an electrically conductive element extending in a general direction along the two generally cylindrical members and effectively sandwiched between portions of the two generally cylindrical members, the electrically conductive element being electrically isolated from the housing member, and two annular electrically conductive coupling components associated with the ends of the electrically conductive element, respectively, one of the electrically conductive coupling components defining a radially inwardly directed electrically conductive coupling margin and the other of the two electrically conductive coupling components defining a radially outwardly directed electrically conductive coupling margin, a body of material of low dielectric constant being provided between the two members, the generally cylindrical lining member of relative high resistance to electrical conduction comprising a collar adjacent to each end of the lining member, each of the electrically conducting coupling components being formed by placing the annular component around a portion of the generally cylindrical lining member of relatively high resistance to electrical conduction, one end of the housing member being provided with a male threaded portion and the other end of the housing member being provided with a female threaded portion, and one end portion of the generally cylindrical lining member of relatively high resistance to electrical conductivity associated with the end of the housing member provided with the male threaded portion being set back from the end of the housing member and the opposite end portion of the generally cylindrical lining member projecting from the end of the housing member provided with the female threaded portion.

* * * * *